US006264763B1

(12) United States Patent
Powell et al.

(10) Patent No.: US 6,264,763 B1
(45) Date of Patent: Jul. 24, 2001

(54) CREEP-RESISTANT MAGNESIUM ALLOY DIE CASTINGS

(75) Inventors: Bob Ross Powell, Birmingham; Vadim Rezhets, Waterford; Aihua A. Luo, Rochester Hills; Basant Lal Tiwari, Sterling Heights, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/302,529

(22) Filed: Apr. 30, 1999

(51) Int. Cl.[7] ..... C22C 23/00

(52) U.S. Cl. ..... 148/420; 148/538; 420/407; 420/410

(58) Field of Search ..... 148/538, 666, 148/420; 420/407, 410

(56) References Cited

U.S. PATENT DOCUMENTS

| | | | |
|---|---|---|---|
| 4,997,622 | 3/1991 | Regazzoni et al. | 420/407 |
| 5,078,962 | 1/1992 | Regazzoni et al. | 420/402 |
| 5,147,603 | 9/1992 | Nussbaum et al. | 420/409 |
| 5,681,403 | 10/1997 | Makino et al. | 148/420 |
| 5,693,158 | 12/1997 | Yamamoto et al. | 148/557 |
| 5,800,640 | 9/1998 | Yamamoto et al. | 148/557 |
| 5,855,697 | 1/1999 | Luo et al. | 148/420 |

FOREIGN PATENT DOCUMENTS

| | | |
|---|---|---|
| 0799901 A1 | 10/1997 | (EP) . |
| 847992 | 9/1960 | (GB) . |
| 6200348 * | 7/1994 | (JP) . |
| 6279906 * | 10/1994 | (JP) . |
| 96/25529 | 8/1996 | (WO) . |

OTHER PUBLICATIONS

Patent Abstracts of Japan, vol. 1996, No. 06, Jun. 28, 1996 (JP 08–041576), Honda Motor Co. Ltd.

Derwent Abstract Accession No. 86–077783/12, Class M26, JP, A, 61–003863 (Ube Industries KK), Jan. 9, 1986.

Derwent Abstract Accession No. 96–515416/51, Class M26, JP, A, 08–269609 (Toyota Chuo Kenkyusho KK), Oct. 15, 1996.

Derwent Abstract Accession No. 94–07228/09, JP, A, 06–025790 (Mitsui Mining & Smelting Co.), Feb., 1994.

Derwent Abstract Accession No. 98–003492/01, JP, A, 09–271919 (Matsuda KK), Oct. 21, 1997.

Hollrigl–Rosta et al, "Magnesium in the Volkswagen," *Light Metal Age*, Aug., 1980, pp. 22–29.

* cited by examiner

*Primary Examiner*—Sikyin Ip
(74) *Attorney, Agent, or Firm*—George A. Grove

(57) ABSTRACT

A family of die castable, creep-resistant magnesium alloys has been developed for high-temperature structural applications such as automotive engines and transmission cases. These alloys contain between 3% and 6% aluminum, 1.7% and 3.3% calcium, and up to 0.2% strontium. They have demonstrated 25% greater tensile and compressive creep resistance than AE42, a commercial aluminum, rare earth containing magnesium alloy, and corrosion resistance as good as AZ91D. These alloys are estimated to cost less than AZ91D and have good castability in metal molds as used in permanent mold casting and die casting.

9 Claims, 3 Drawing Sheets

CREEP-RESISTANT MAGNESIUM ALLOY DIE CASTINGS

TECHNICAL FIELD

This invention pertains to the die casting of creep-resistant magnesium alloys. More specifically, this invention pertains to magnesium alloys that can be successfully cast as liquids into metal dies or molds and provide castings having creep resistance for relatively high temperature applications.

BACKGROUND OF THE INVENTION

The use of magnesium to reduce weight in automobiles has grown approximately 20% annually since the early 1990s. Most of this growth has been with interior component applications and, at the present time, the only magnesium powertrain components in production are nonstructural and in relatively low-temperature applications. Volkswagen used magnesium alloys AS41A and AS21 (Mg-4%Al, 1% Si and Mg-2% Al, 1% Si, respectively) in the 1970s to cast air-cooled engine blocks. Usage of these alloys ended when engine operating temperatures increased and the cost of magnesium increased. If the advantages of magnesium are to be extended to current engines and automatic transmission components, for example, several existing problems will have to be overcome.

Four issues for the use of magnesium permanent mold or die casting alloys in automotive powertrain components are: (1) creep (i.e., continued strain under stress), (2) cost, (3) castability and (4) corrosion. For example, the commercial die casting magnesium alloys (AZ91D, containing aluminum, zinc and manganese; AM60 and AM50, both containing aluminum and manganese) currently used in the automobile are limited to near-room-temperature applications because their mechanical properties decrease at higher temperatures and they are susceptible to creep at powertrain operating temperatures. AE42 is a rare earth element-containing magnesium die casting alloy (E designates mischmetal) that has creep resistance sufficient for automatic transmission operating temperatures (up to 150° C.), but not engine temperatures (above 150° C.).

Some magnesium alloys formulated for sand or permanent mold casting do provide good high-temperature properties and are used in aerospace and nuclear reactors. The high costs of exotic elements (Ag, Y, Zr and rare earths) used in these alloys prevent their use in automobiles.

Cost is also a major barrier to the consideration of magnesium for powertrain components. However, the cost differential between magnesium alloys and aluminum or iron is not as great as anticipated when costs are compared on an equal-volume basis. On a per pound basis, magnesium is significantly more expensive than iron and aluminum. However, when the density of the metals is considered and cost is adjusted to a per-unit volume basis, the cost differential is much less. Furthermore, using the costs of magnesium alloys that are sometimes projected, the differential per pound between magnesium and aluminum will be even less than the differential between aluminum and iron. Unfortunately, AE42 with its rare earth content is more expensive than the low-temperature magnesium alloys, so cost of high-temperature strength magnesium alloys remains an issue.

Castability has been an advantage of the current low-temperature magnesium alloys. These alloys are fluid and readily flow into and fill thin mold sections. In many of the non-powertrain applications, the conversion to Mg has enabled cost reduction by parts consolidation: casting complex parts rather than assembling many simpler parts. The excellent castability of these low-temperature magnesium alloys has also increased design flexibility and the use of thinner walls, both of which will be beneficial in powertrain components if the creep-resistant alloy has the same good castability. Unfortunately, AE42 and other proposed creep-resistant alloys do not have as good castability as AZ91D, AM60 and AM50. For example, some otherwise creep-resistant alloys tend to weld or seize to a metal die or their castings form cracks and must be rejected.

A fourth major concern for magnesium components is their corrosion behavior. This is because the powertrain components will be exposed to road conditions and salt spray. Corrosion has been overcome in the low-temperature alloys because their purity is carefully controlled and fastening techniques to prevent galvanic coupling have been established. Any powertrain alloy will need to have this same level of corrosion resistance.

Thus, one can project creep resistance, cost, castability and corrosion resistance as the key issues for a Mg alloy suitable for an internal combustion engine block or head or for a transmission case and then set requirements for the alloy that they will use, e.g.:

creep strength—20% greater than AE42 at 150° C.

cost, castability and corrosion resistance—equivalent to AZ91D

There remains a need for a magnesium alloy that can be forced into a die as a liquid, or poured into a permanent mold, and solidified to yield a casting that provides creep strength and corrosion resistance.

SUMMARY OF THE INVENTION

This invention provides a family of Mg—Al—Ca—X alloys (referred to hence as ACX alloys) that are suitable for die casting or permanent mold casting. The cast products meet requirements for structural parts operating at temperatures of 150° C. and higher, e.g., automotive powertrain components. The alloys of this invention provide, in combination, the useful and beneficial properties of castability and moderate cost. Casting produced from the alloys display creep and corrosion resistance during prolonged exposure to such temperatures and environmental conditions typically required of powertrain components.

As stated, the subject alloys are suited for use in casting operations generally whether conducted at low pressure, as in permanent mold casting, or at high pressure as in die casting. But the alloys are particularly suitable for use in die casting or similar casting processes in which molten magnesium alloy at a temperature well above its liquidus temperature is introduced into a metal mold (a die) and cooled and subjected to squeezing or pressure as the melt solidifies. Such pressure or squeeze casting processes are used to make castings of complex shape, often with thin wall portions, such as automobile and truck engine blocks and heads and transmission cases.

For some such casting applications, suitable alloys comprise, by weight, about 3% to 6% aluminum, about 1.7% to 3.3% calcium, incidental amounts (e.g., up to 0.35%) of manganese for controlling iron content, minimal amounts of normally present impurities such as iron (<0.004%), nickel (<0.001%) and copper (<0.08%), and the balance magnesium. Each constituent may be varied within its specified range independent of the content of the other constituents. Small amounts of silicon, e.g., up to about 0.35% by weight, may also be suitably used. This family of magnesium, aluminum and calcium alloys satisfies the castability, creep resistance, corrosion resistance and cost requirements for many high-temperature, structural casting applications. The metallurgical microstructure is characterized by the presence of a magnesium-rich matrix phase with an entrained or grain boundary phase of $(Mg,Al)_2Ca$. However, the addition of strontium in relatively small amounts, suitably about 0.01% to 0.2% by weight and preferably 0.05% to 0.15%, provides a significant improvement in the creep-resistant properties of the alloys, especially at application temperatures of 150° C. to 175° C. and higher. This property of the subject Mg—Al—Ca—Sr alloys enables castings of the compositions to retain utility after hundreds of hours of exposure to such temperatures.

Other objects and advantages of the subject invention will become more obvious from a detailed description which follows. Reference will be had to the drawings which are described in the following section.

DESCRIPTION OF THE PREFERRED EMBODIMENT

Figure 1:
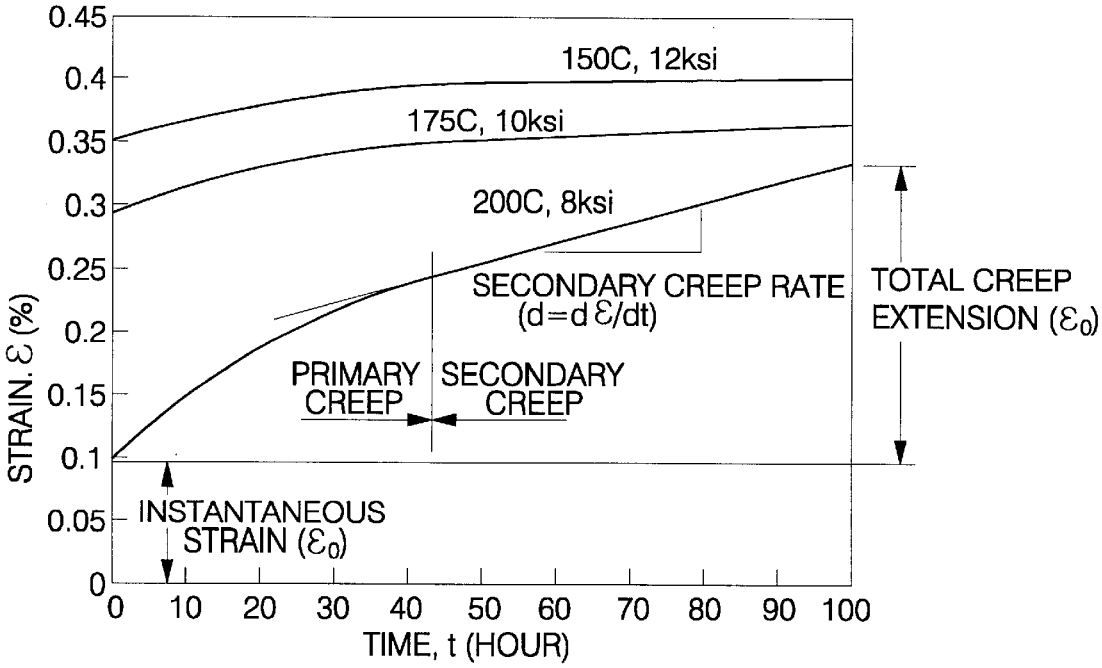
FIG. 1 is a graph of creep strain curves for magnesium-aluminum (5%)-calcium (2%) alloys at constant temperatures of 150° C., 175° C. and 200° C. under constant loads of 12 ksi, 10 ksi and 8 ksi, respectively.

Commercial magnesium die casting alloy AE42, containing about 4% aluminum and 2% mischmetal, was described above as having suitable creep resistance for automatic transmission applications. Since better creep resistance is required for engine block applications and the like, a study was made of the metallurgy of AE42 at elevated temperatures in compressive stress retention (CSR) tests.

Creep resistance, whether tensile or compressive stress, is a major requirement for use of Mg alloys in powertrain components. Creep resistance under compressive load is necessary in order to maintain bolt torque and dimensional stability of cast bodies during vehicle operation. A functional creep test was developed by the assignee of this invention that simulates the clamp load that a magnesium flange will experience in a bolted assembly. Sieracki, E. G., Velazquez, J. J., and Kabri, K., "Compressive Stress Retention Characteristics of High Pressure Die Casting Magnesium Alloys," SAE Technical Publication No. 960421 (1996). A magnesium alloy CSR square block sample is sandwiched between washers and nuts on a threaded steel rod fitted through a cast hole in the Mg sample block. Load is applied to the sample by tightening the nuts at the ends of the bolt. The clamp load (compressive stress) can be determined by measuring the stretch of the steel rod. The sample is loaded to the desired compressive stress and placed in a constant temperature bath for up to 750 to 1000 hours. Of course, as the sample yields under the load (i.e., creeps), the steel rod becomes shorter.

Microstructure analysis of die cast CSR specimens of AE42 revealed a correlation between the creep resistance in compressive stress retention and the after-test microstructure. The microstructure of the die-cast specimens consisted essentially of magnesium dendrites with a lamellar interdendritic phase of $Al_{11}E_3$. The lamellar $Al_{11}E_3$ phase dominated the microstructure of the CSR samples.

Above 150° C., the creep resistance deteriorated.

It was shown that the breakdown in the creep resistance of AE42 above 150° C. is accompanied by a phase change in the microstructure of this alloy; specifically, the decomposition of $Al_{11}E_3$ and the formation of $Al_2E$ and $Mg_{17}Al_{12}$. $Mg_{17}Al_{12}$ is a low-melting-temperature phase that is present in commercial alloys AZ91D, AM60, and AM50 and to which is attributed the poor creep behavior of these alloys. These results suggested that increasing the thermal stability of $Al_{11}E_3$ might be a means for extending the creep resistance of AE42 to above 150° C. It also suggested the possibility of developing lower cost, creep-resistant alloys by replacing the rare earth in AE42 with a less expensive element that also forms an $Al_{11}E_3$-type strengthening phase.

$Al_{11}E_3$-type phases have been reported in Al-alkaline earth (Ca, Sr, and Ba) compounds. Of the three alkaline earths, calcium is the least expensive on a cost per pound basis. It also has the lowest density and atomic weight, such that the "cost per atom of Ca" is significantly less than that of Sr or Ba. For these reasons, Ca was selected for this study. Strontium and silicon were included in the study as possible fourth-element additions for modifying precipitates and further improving the alloy.

Previous work has reported that Ca imparts creep resistance to Mg—Al alloys, but it was also reported that the resulting alloys are difficult to cast because the castings stick to the die and are prone to hot cracking. Some workers prevented die sticking and hot cracking by limiting the Ca level to below 0.5%. These casting problems were also reduced by the addition of zinc, but the resulting alloy achieved the satisfactory creep resistance only up to 150° C.

A group of magnesium-aluminum-calcium based alloys were prepared to overcome the deficiencies of prior art alloys.

EXPERIMENTAL PROCEDURE

Composition Ranges and Melt Preparation

The alloys were cold chamber die cast. The compositions cast are shown in Table 1. The metals used in alloying were AM50, Mg, Al, Ca, Sr (as Sr10-Al), and Si (as AS41 alloy containing about 1% Si). Recovery was greater than 95%. Although not reported in the table, each alloy also contained up to about 0.3% by weight manganese and very small amounts of iron, nickel and copper.

TABLE 1A

Magnesium Alloy Compositions (weight percent)

| Alloy | Designation | Chemical Composition (wt. %) Al | Ca | Si | Sr |
|---|---|---|---|---|---|
| A | AM50 | 4.7 | — | — | — |
| B | AC52 | 4.5 | 1.9 | — | — |
| C | AC53 | 4.5 | 3.0 | — | — |
| D | AC53 + 0.3% Si | 4.5 | 2.9 | 0.26 | — |
| E | AC53 + 0.3% Si + 0.1% Sr | 5.4 | 2.9 | 0.27 | 0.11 |
| F | AC53 + 0.3% Si + 0.15% Sr | 5.7 | 3.0 | 0.28 | 0.15 |
| G | AC53 + 0.03% Sr | 4.7 | 3.1 | — | 0.03 |
| H | AC53 + 0.07% Sr | 5.0 | 3.1 | — | 0.07 |
| I | AC53 + 0.15% Sr | 5.7 | 3.1 | — | 0.15 |
| K | AC52 + 0.1 Sr | 4.5 | 1.9 | — | 0.1 |
| L | AC62 + 0.2 Sr | 6.0 | 2.1 | — | 0.2 |

Melting and alloying was done with $SF_6$ cover gas.

Die Design and Casting Conditions

The first die insert made for these new and previously uncast alloys contained four cavities: one 12 mm-diameter tensile bar, one 6 mm-diameter tensile bar, and two 38 mm, square compressive stress retention (CSR) coupons, 12 and 6 mm thick, respectively. Initially there was difficulty filling the mold. Both tensile bar cavities showed porosity and misruns. Changes to the gating system were made, but filling did not improve. Only the CSR coupons and a small number of 6 mm tensile bars were suitable for testing. Additionally, casting procedures resulted in large inclusions in the samples.

Before the second set of die casting experiments, the die insert was modified. In particular, the tensile bars were end-gated and the 6 mm thick CSR coupon was blocked out of the system. These changes were made to improve the soundness of the castings. A different die cast unit (a 700 ton Lester machine) that was better instrumented (QPC Prince die temperature control) and afforded better control of the casting conditions was employed. The melt temperature was controlled at 1250° F. (677° C.) plus/minus 5° F. and the die surface temperature was maintained at about 660° F. (350° C.). The changes in insert design, casting conditions and procedures resulted in good castings. The properties reported in this work were measured on the second group of samples cast.

In the third set of casting trials, a notebook computer case was cast using the magnesium alloys shown below:

TABLE 1B

Magnesium Alloy Compositions (wt. %) Used in Castability Study

| Alloy | Al | Ca | Sr | Mn | Fe | Ni | Cu |
|---|---|---|---|---|---|---|---|
| *AM50 | 4.4 | <0.01 | <0.0005 | 0.25 | <0.002 | <0.002 | <0.003 |
| *AC51 | 4.6 | 0.87 | <0.0005 | 0.28 | 0.002 | <0.002 | <0.003 |
| *AC52 | 4.5 | 1.7 | 0.0006 | 0.30 | 0.002 | <0.002 | <0.003 |
| *AC53 | 4.4 | 2.6 | 0.0008 | 0.30 | 0.002 | <0.002 | <0.003 |
| *AC53 + 0.1 Sr | 5.2 | 2.6 | 0.09 | 0.29 | 0.004 | <0.002 | <0.003 |
| *AC63 + 0.2 Sr | 5.9 | 2.5 | 0.17 | 0.29 | 0.005 | <0.002 | <0.003 |

These compositions (alloys identified by the * in front of each alloy to distinguish them from the alloys in Table 1A) were alloyed in the melt, as before. The notebook computer case was designed for aluminum but somewhat modified to cast AZ91D. Without further changing the part design or that of the gate and runner system in the die, cases were cast from alloys at a melt temperature of between 1250° F. (677° C.) and 1290° F. (699° C.).

Specimen Analysis

Sample chemistries were measured for each casting composition using inductively coupled plasma/atomic emission spectroscopy (ICP/AES). X-ray diffraction (XRD) was used to identify phases in the microstructure. The lattice parameters and weight percent of α-Mg were calculated using the Rietveld method. Additional microstructural analysis was done using analytical electron microscopy with energy dispersive spectroscopy and electron diffraction (AEM). The AEM samples were prepared by ion milling.

Creep Testing

Creep strength is the stress required to produce a certain amount of creep at a specific time and a given temperature. It is a creep parameter often required by design engineers for evaluating the load-carrying ability of a material for limited creep deformation in prolonged time periods. It is a common practice to report creep strength as the stress that produces 0.1% total creep extension at 100 hours and a given temperature. This and other creep data for magnesium alloys of the subject invention are reported below.

Tensile creep testing was done at 150° C., 175° C., and 200° C. Samples for each test were selected on the basis of casting quality as determined by X-ray inspection. Threads were machined into the grip regions of the 6-mm diameter tensile bars so that they could be held in the test fixtures. Tensile creep testing was done under constant-load, constant-temperature conditions. Total creep extension in 100 h at the test temperature was recorded as were the primary and secondary regions of the creep curves.

Compressive creep was characterized by compressive stress retention (CSR) measurements at 150° C. and 175° C. CSR simulates the bolt load retention performance of the alloy and is a critical functional test for a powertrain component with regard to the integrity of the parts that are bolted to the component.

Corrosion Behavior

CSR samples were evaluated using an accelerated laboratory corrosion test employing a combination of cyclic conditions (salt solution, various temperatures, humidity, and ambient environment) to simulate the equivalent of ten years' corrosion exposure for some metal systems (General Motors test GM 9540P). It was concluded that this test would serve as the basis for comparing the corrosion behavior of the ACX alloys with AZ91D.

Castability Ratings

The castings were inspected visually and by X-ray. Some parts were sectioned to confirm the defect type; e.g., hot cracking versus cold cracking. Each defect present was assigned a level of severity ranging from 0 (most severe) to 5 (the defect was absent).

RESULTS AND DISCUSSION

Tensile Creep Behavior

FIG. 1 is a typical creep strain vs. time curve obtained from the constant-load and constant-temperature test for alloy AC52. As shown in FIG. 1, total creep extension ($\epsilon_t$) measures the total time-dependent strain (creep strain) of a material under constant load at a given temperature for a specific time period and is the most frequently used parameter in the literature for reporting creep properties for magnesium alloys. FIG. 1 also shows that AC52 alloy, as most other metals and alloys exhibits two stages of creep, i.e., primary or transient creep, and secondary or steady state creep. The primary and secondary creep strains ($\epsilon_1$ and $\epsilon_2$, respectively) for the subject alloys can be described by the following equations:

$$\epsilon_1 = at^b$$

$$\epsilon_2 = c + dt$$

where t is time; and a, b, c and d are constants. Among these four constants, d represents the secondary creep rate and is the most important design parameter derived from the creep curve. Both $\epsilon_t$ and d data are reported for the subject alloys in the following Table 2. Table 3 reports the tensile creep strength at 175° C.

TABLE 2

Total Creep Extension and Secondary Creep Rate Data

| | | Total Creep Extension, $\epsilon_t$ (%) | | | Secondary Creep Rate, d ($\times 10^{-10}$ $s^{-1}$) | | |
|---|---|---|---|---|---|---|---|
| Alloy Designation | | 150° C. 12 ksi | 175° C. 10 ksi | 200° C. 8 ksi | 150° C. 12 ksi | 175° C. 10 ksi | 200° C. 8 ksi |
| A | AE42 | 0.11 | 0.12 | — | 9.85 | 14.52 | — |
| B | AC52 | 0.05 | 0.06 | 0.26 | 4.86 | 6.95 | 34.30 |
| C | AC53 | 0.07 | 0.09 | 0.28 | 6.94 | 8.64 | 56.40 |
| D | AC53 + 0.3 Si | 0.06 | 0.07 | 0.25 | 6.94 | 13.88 | 33.28 |
| E | AC53 + 0.3 Si + 0.1 Sr | 0.03 | 0.07 | 0.18 | 4.63 | 6.94 | 22.24 |
| F | AC53 + 0.3 Si + 0.15 Sr | 0.05 | 0.06 | 0.14 | 7.29 | 9.90 | 18.90 |
| G | AC53 + 0.03 Sr | 0.06 | 0.08 | 0.28 | 9.26 | 12.35 | 54.49 |
| H | AC53 + 0.07 Sr | 0.05 | 0.06 | 0.20 | 5.79 | 9.26 | 18.53 |
| I | AC53 + 0.15 Sr | 0.04 | 0.08 | 0.16 | 3.70 | 5.56 | 11.11 |
| K | AC52 + 0.1 Sr | 0.04 | 0.05 | 0.21 | 6.94 | 7.50 | 28.64 |
| L | AC62 + 0.2 Sr | 0.06 | 0.08 | 0.19 | 7.28 | 10.42 | 34.72 |

TABLE 3

Creep Strength at 175° C.
(Stress to Produce 0.1% Creep Strain in 100 Hours)

| Alloy | AZ91D | AS41 | AS21 | AE42 | AC52 | AC53 | Alloy E | Alloy I | AA380 |
|---|---|---|---|---|---|---|---|---|---|
| ksi | 1.4 | 1.9 | 4.6 | 7.2 | 10.8 | 10.6 | 11.9 | 11.9 | 13.4 |

As seen in both of the above tables, each ACX alloy provided increased tensile creep strength as compared to AE42 and the AS alloys. Each new alloy had at least 20% greater creep strength than AE42 at 150° C. The 0.1% creep strength of AE42 at this temperature is 9.4 ksi; i.e., the total creep extension of AE42 at a load of 9.4 ksi and at 150° C. will be less than 0.1% in 100 hrs. At 12 ksi (28% greater load), the creep strain of the ACX alloys averages 0.05%, less than half that of AE42 specimens. At 175° C., the ACX alloys are nearly 50% better than AE42. There is an indication in the creep data that microalloying with more than about 0.15% Sr further improves the creep-resistant but the effect is very small. The limited data obtained for Si shows no significant effect.

Compressive Creep Behavior

Figure 2:
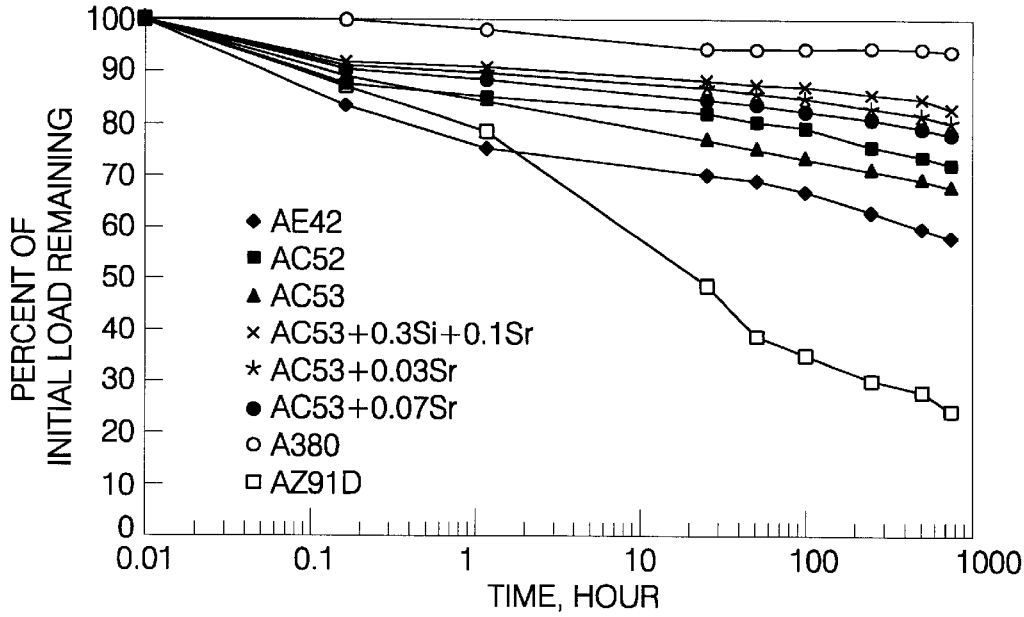
FIG. 2 is a graph of the compressive stress retention of die cast commercial aluminum alloy 380, commercial magnesium alloys AE42 and AZ91D and various ACX alloys of this invention at 150° C. for times up to 750 hours.
Figure 3:
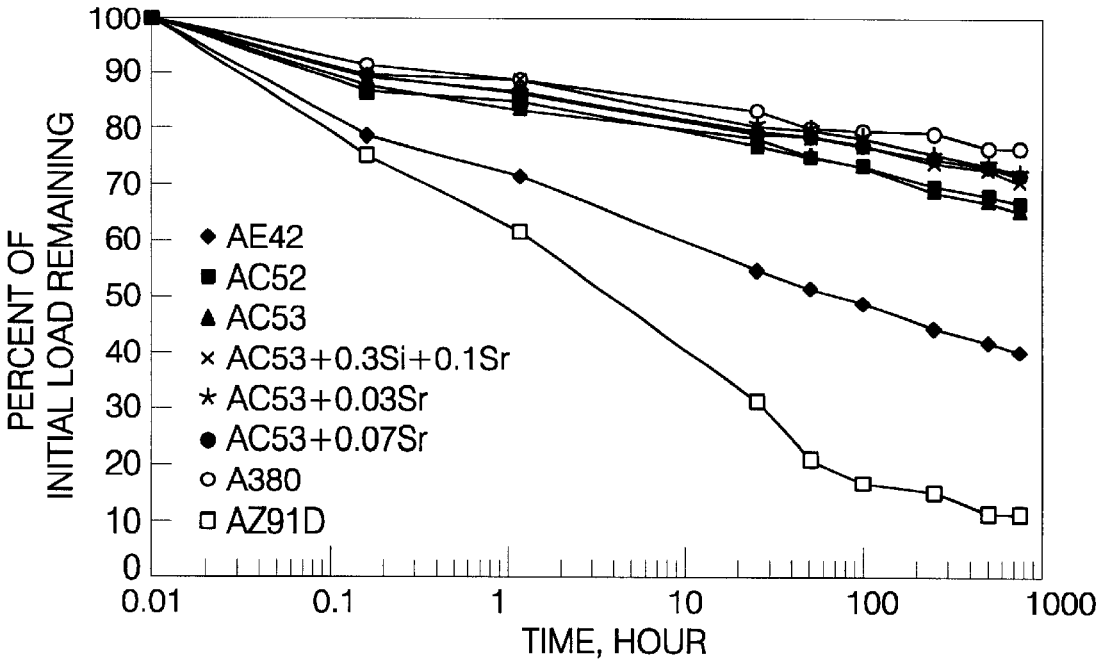
FIG. 3 is a graph of the compressive stress retention of die cast commercial aluminum alloy 380, commercial magnesium alloys AE42 and AZ91D and various ACX alloys of this invention at 175° C. for times up to 750 hours.

As stated, compressive creep resistance is an important criterion for the block material because it is a measure of how tight the bolts remain in the assembled engine. As measured by compressive stress retention (CSR), the ACX alloys are much better than AE42 (see FIGS. 2 and 3). In these figures, CSR is presented as the percent of load (stretch) remaining in the bolted sample as a function of the time of exposure up to 750 hrs at the indicated temperature. The previously published CSR behavior of AZ91D and aluminum A380 is included in the figures for comparison.

At 150° C. and 750 hours, AE42 retained 58% of the initial load while the ACX alloys CSR ranged from 68% to 82%, all better than AE42. At 175° C., the CSR of AE42 dropped considerably, to 40%. This is due to the decomposition of $Al_{11}E_3$ with the subsequent formation of $Mg_{17}Al_{12}$. The ACX alloys do not demonstrate the same deterioration with increasing temperature. They retain nearly as much load as they did at 150° C., 65% vs. 72%. As with the tensile creep results, the addition of Sr appears to further improve creep resistance but the effect is much more evident in the CSR results. In fact, the Sr-microalloyed AC53 samples performed almost as well as the commercial aluminum casting alloy, A380.

Figure 4:
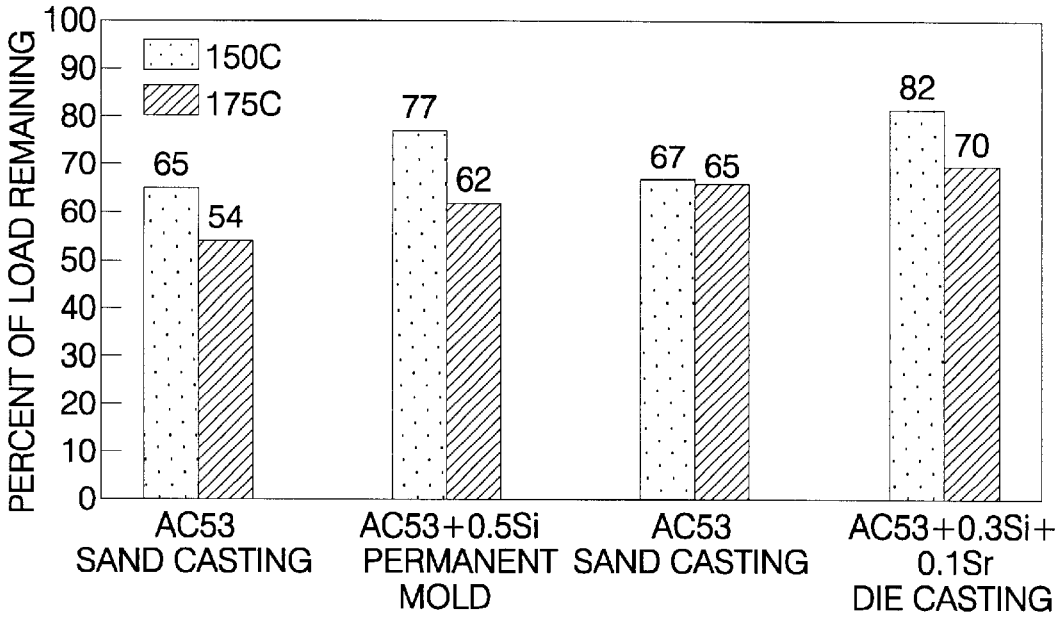
FIG. 4 is a block graph of the compressive stress retention of variously cast ACX alloys at 150° C. and 175° C. for 750 hours.

FIG. 4 summarizes CSR test results for 750 hours for AC53 alloy when sand cast and die cast. Also summarized is CSR data for AC53+0.5Si alloy cast in a permanent mold as well as data for AC53+0.3Si+0.1Sr alloy when die cast. These results suggest that that ACX alloys prepared by sand or permanent mold casting processes have similar creep resistance as that of the die cast alloys.

Corrosion Behavior

The ACX alloys have excellent creep resistance for use in engine and transmission applications. Another major performance concern is their corrosion behavior. The subject ACX alloys are herein compared with AZ91D as the benchmark in a ten-year equivalent accelerated corrosion test. The data is summarized in the following Table 4.

TABLE 4

Percent Weight Loss of Magnesium Test Coupons in a Cyclic Salt Spray Corrosion Test

| Alloy Composition | (% loss) |
|---|---|
| AZ91D | 0.4 |
| AM50 | 0.7 |
| AC52 | 1.5 |
| AC53 | 2.1 |
| AC53 + 0.3 Si | 1.6 |
| AC53 + 0.3 Si + 0.10 Sr | 1.0 |
| AC53 + 0.3 Si + 0.14 Sr | 1.0 |

TABLE 4-continued

| Percent Weight Loss of Magnesium Test Coupons in a Cyclic Salt Spray Corrosion Test | |
|---|---|
| Alloy Composition | (% loss) |
| AC53 + 0.02 Sr | 0.8 |
| AC53 + 0.05 Sr | 0.6 |
| AC53 + 0.10 Sr | 0.5 |

Table 4 shows that the ACX alloys microalloyed with Sr perform as well as AZ91D. Over two independent test series, the AZ91D averaged 0.5% weight loss. AM50 did nearly as well as AZ91D. The ACX alloys with X ranging from 0.05% to 0.1% Sr also achieved this level of corrosion resistance. The data shows that increasing Sr levels improved the corrosion resistance and the Si appeared to be detrimental. The effect of 2% vs. 3% Ca is not clear because there was more scatter in the individual results. Each reported value in each series was generally the average of three samples.

Other data in the corrosion tests reaffirm a lesson that has been learned about the effect of iron content on the corrosion rate of Mg. Iron, like Ni and Cu, substantially increases the corrosion rate of AZ and AM alloys. A key to minimizing corrosion of magnesium is to minimize the presence of iron, nickel, and copper.

Microstructure and Casting Characterization

In an early phase of this study, the Mg—Al—Ca ternary was surveyed for microstructural features by drawing pin samples from a Mg-4% Al melt after successive additions of Ca to the melt. Pin samples were collected by vacuum suctioning from the melt into a 5 mm diameter glass tube. Below 1% Ca, only α-Mg was identified in the XRD pattern. At and above 1% Ca, a second phase was also identified, $Mg_2Ca$, the amount increasing as the Ca level in the melt was increased. Observed lattice parameter shifts are consistent with substitution of Al on Mg sites, $(Mg, Al)_2Ca$, in this phase. As the Ca content of the melt increased, the lattice parameter shifted in the direction of lower substitution, i.e., less Al in the phase. However, at the same time, the amount of this phase increased from zero to nearly 20%. This would result in a shifting of Al from the primary Mg to the Mg—Al—Ca ternary.

Correspondingly, as the Ca content increased and the amount of α-Mg decreased from 100% to 80%, the Mg phase also underwent a change in its lattice parameters that corresponded to the removal of Al from solution in the phase.

The new internetallic phase, $(Mg, Al)_2Ca$, has a relatively high melting point (715° C.), indicating a good thermal stability. It has the same crystal structure (hexagonal) as the magnesium matrix with a small lattice mismatch (3% to 7%) at the $Mg/(Mg, Al)_2Ca$ interface, leading to a coherent interface. Both the thermal stability and the interfacial coherency of the $(Mg, Al)_2Ca$ provide the pinning effect at the magnesium grain boundary, thereby improving the creep resistance of the alloys.

No other phases were identified, and no evidence of $Al_4Ca$ or $Mg_{17}Al_{12}$ was detected. However, these results were based on the analysis of pin samples which, as noted, were used only to simulate die casting solidification rates. Subsequent AEM analysis of the die cast AC53 clearly revealed the ternary lamella in the eutectic regions of the alloys. These lamella had the hexagonal $Mg_2Ca$ phase structure with approximately half of the Mg atoms replaced with Al. Thus, while $Al_4Ca$ was not detected, neither was $Mg_{17}Al_{12}$. This and the absence of Al solid solution in α-Mg indicates that the Ca is still performing its role of functionally removing Al from the alloy and preventing the formation of $Mg_{17}Al_{12}$, thereby accounting for the improved creep resistance.

Castability and Casting Quality

The ACX alloys of this invention have excellent creep resistance, corrosion resistance, and tensile properties. Since they require no rare earth elements, it is estimated that these alloys will be less costly than AZ91D. Castability is an additional requirement.

In die casting experience to date, with the ACX alloys, they have shown excellent castability. Even though work has been limited to casting small, simple parts, e.g., the tensile bars and compressive stress retention samples, these castings allow assessment of such castability parameters as die sticking, hot cracking, and fluidity (a measure of the ability to fill thin sections of the die). Die sticking was limited to alloy compositions where Ca was low and did not occur for Ca levels above 2%. Even on small samples, hot cracking could have been indicated by the surface condition of the parts. All samples showed smooth surfaces and no evidence of cracking. Occasionally, centerline porosity was detected in the tensile bars, but this was eliminated by increasing the die temperature. Otherwise, castings were generally sound.

Figure 5:
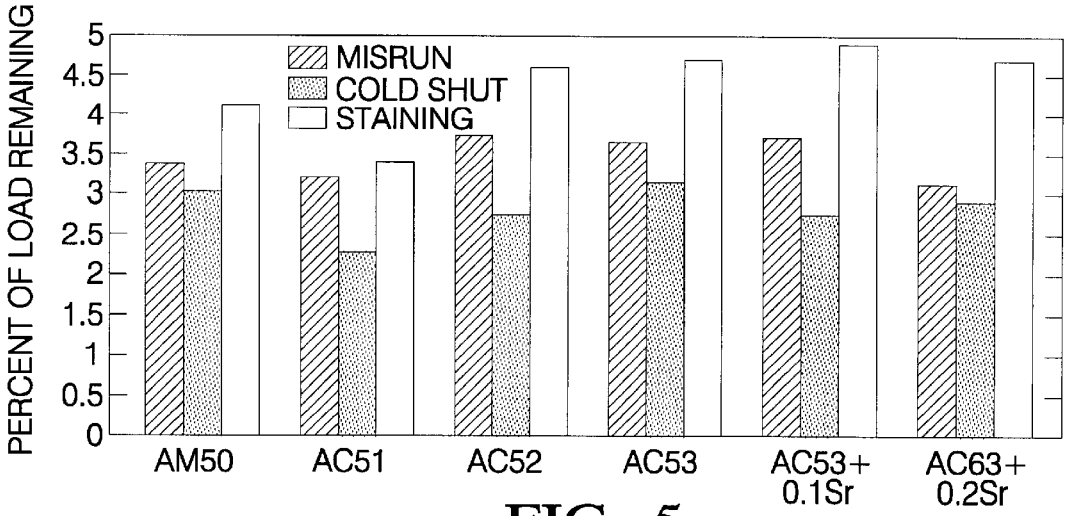
FIG. 5 is a block graph of castability ratings (with respect to misrun, cold shut and staining) for AM50, a commercial magnesium alloy considered to have very good casting properties, AC51 alloy and various ACX alloys.
Figure 6:
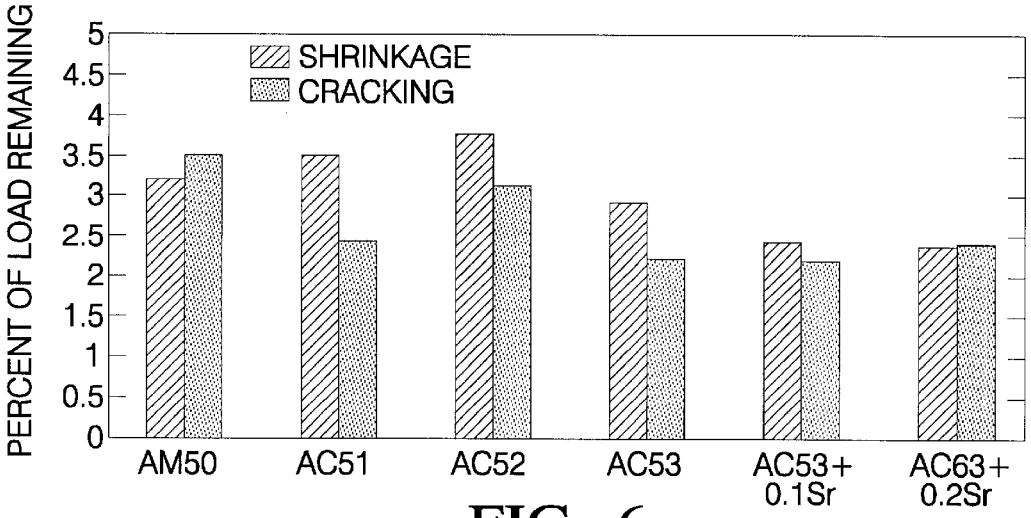
FIG. 6 is a block graph of castability ratings (with respect to shrinkage and cracking) for AM50 alloy, AC51 alloy and various ACX alloys.
Figure 7:
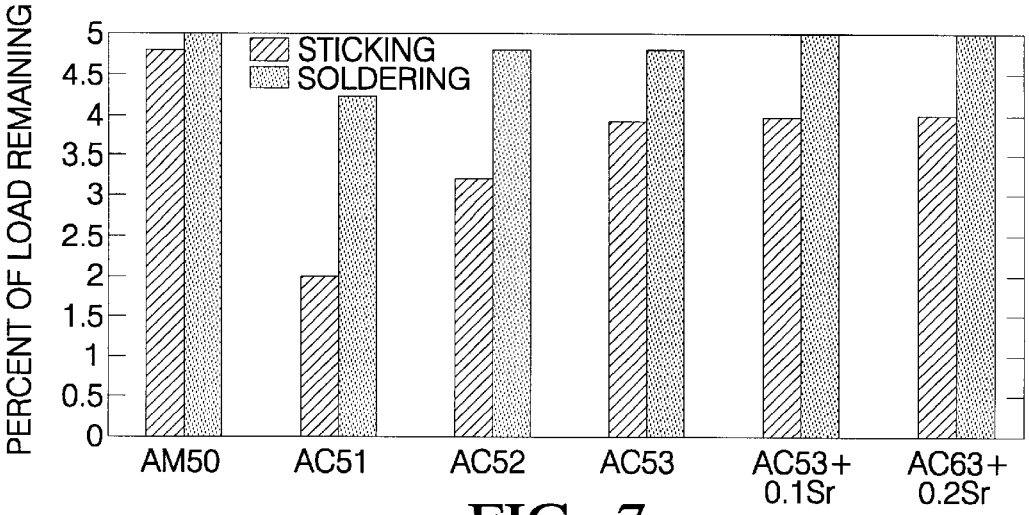
FIG. 7 is a block graph of castability ratings (with respect to sticking and soldering) for AM50 alloy, AC51 alloy and various ACX alloys.

With respect to the castability of the alloy in the computer case die, several defect types were identified. While many of the defects would be eliminated by changes in the part design, the gating and running system design, or in the casting parameters, these factors were all held constant in order to assess only the effect of alloy composition on castability. FIGS. 5–7 show that the defect severities are generally sensitive to composition. In particular, cold shuts, staining of the casting surface, hot cracking, die sticking and soldering of the casting to the die all become more severe when 1% Ca is added to AM50. Of course, AM50 is an alloy that is recognized as a good die casting or permanent mold casting alloy. But, when the Ca level is increased to ~2%, the defects diminish. These results were in agreement with the previous casting trials in which only tensile and creep specimens were cast. In the cases of misruns and shrinkage, alloying with Ca (with or without Sr) has less effect. The optimum level of Ca is approximately 2%. This level is also optimum for creep and corrosion resistance. Whereas Sr has been shown to be beneficial for creep and corrosion resistance, its effect on casting defects is negligible.

On the basis of these experiments, it was concluded that the castability of these alloys for small parts is excellent, at least as good as that of AZ91D and that for the thin-wall part, the notebook computer case, the castability of the alloys was about the same as that of AM50. No AZ91D was cast in the notebook casting trials, although the vender had prior experience indicating that the case could be cast successfully with AZ91D.

While this invention has been described in terms of some specific embodiments, it will be appreciated that other forms can readily be adapted by one skilled in the art. Accordingly, the scope of this invention is to be considered limited only by the following claims.

What is claimed is:

1. A method of making a creep-resistant magnesium alloy casting in a metal mold comprising filling said mold with a molten alloy consisting essentially, by weight, of 3% to 6% aluminum, 1.7% to 3.3% calcium, 0.05% to 0.2% strontium, up to 0.35% manganese, and the balance, except for inconsequential impurities, magnesium and solidifying said alloy in said mold such that said casting comprises a $(Mg, Al)_2Ca$ phase.

2. A method of making a creep-resistant magnesium alloy casting as recited in claim 1 in which said molten alloy comprises, by weight, 2% to 3% calcium and 0.05% to 0.15% strontium.

3. A method of making a creep-resistant magnesium alloy casting as recited in claim 1 in which said molten alloy comprises, by weight, 3% to 6% aluminum, 1.7% to 3.3% calcium, 0.05% to 0.2% strontium, 0% to 0.35% silicon, less than 0.35% manganese, less than 0.004% iron, less than 0.001% nickel, less than 0.08% copper and the balance, except for inconsequential impurities, magnesium.

4. A method of making a creep-resistant magnesium alloy casting comprising forcing a molten magnesium alloy into a die cavity, cooling the alloy in the cavity to solidify it into said casting and subjecting the molten alloy to pressure during such cooling and solidification, said alloy having a composition comprising, by weight, 3% to 6% aluminum, 1.7% to 3.3% calcium, 0.05% to 0.2% strontium, 0% to 0.35% silicon, 0.1% to 0.35% manganese, less than 0.004% iron, less than 0.001% nickel, less than 0.08% copper and the balance, except for inconsequential impurities, magnesium, said casting comprising a $(Mg, Al)_2Ca$ phase.

5. A method of making a creep-resistant magnesium alloy casting as recited in claim 4 in which said alloy comprises 0.05% to 0.15% strontium.

6. A creep-resistant magnesium alloy pressure casting produced by forcing a molten magnesium alloy into a metal die cavity, cooling the alloy in the cavity to solidify it into said casting and subjecting the molten alloy to pressure during such cooling and solidification, said alloy having a composition comprising, by weight, 3% to 6% aluminum, 1.7% to 3.3% calcium, 0.05% to 0.2% strontium, 0% to 0.35% silicon, less than 0.35% manganese, less than 0.004% iron, less than 0.001% nickel, less than 0.08% copper and the balance, except for inconsequential impurities, magnesium, said casting comprising a $(Mg, Al)_2Ca$ phase.

7. A creep-resistant magnesium alloy pressure casting as recited in claim 6 comprising 0.05 to 0.15% strontium.

8. A creep-resistant magnesium alloy pressure casting produced by pouring a molten magnesium alloy into a metal mold cavity and cooling the alloy in the cavity to solidify it into said casting, said alloy having a composition comprising, by weight, 3% to 6% aluminum, 1.7% to 3.3% calcium, 0.05% to 0.2% strontium, 0% to 0.35% silicon, less than 0.35% manganese, less than 0.004% iron, less than 0.001% nickel, less than 0.08% copper and the balance, except for inconsequential impurities, magnesium, said casting comprising a $(Mg, Al)_2Ca$ phase.

9. A creep-resistant magnesium alloy casting as recited in claim 8 comprising 0.05% to 0.15% strontium.

* * * * *